US008229337B2

(12) United States Patent
Nagai et al.

(10) Patent No.: US 8,229,337 B2
(45) Date of Patent: Jul. 24, 2012

(54) IMAGE FORMING APPARATUS INCLUDING A TRANSFER-MATERIAL GUIDE SECTION WITH SUCTION

(75) Inventors: Yoshiyuki Nagai, Shiojiri (JP); Katsuhito Gomi, Chino (JP); Kenjiro Yoshioka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 169 days.

(21) Appl. No.: 12/764,220

(22) Filed: Apr. 21, 2010

(65) Prior Publication Data

US 2010/0272479 A1 Oct. 28, 2010

(30) Foreign Application Priority Data

Apr. 22, 2009 (JP) ..... 2009-103667

(51) Int. Cl.
*G03G 15/01* (2006.01)

(52) U.S. Cl. ..... 399/304; 399/305

(58) Field of Classification Search ..... 399/304, 399/305, 322, 397, 400
See application file for complete search history.

(56) References Cited

U.S. PATENT DOCUMENTS 6,243,556 B1 6/2001 Shin
6,957,035 B1 * 10/2005 Giannetti et al. ..... 399/322

FOREIGN PATENT DOCUMENTS

JP 03-004241 1/1991
JP 06-135613 5/1994
JP 2000-267449 9/2000
JP 3128067 11/2000

* cited by examiner

*Primary Examiner* — Hoang Ngo
(74) *Attorney, Agent, or Firm* — Workman Nydegger

(57) ABSTRACT

An image forming apparatus including: an image carrier that carries an image; a transfer roller having a transfer material-gripping member that grips a transfer material, the transfer roller transferring the image carried by the image carrier to the transfer material; a transfer material-transporting belt that transports the transfer material onto which the image has been transferred while subjecting the transfer material to suction; a fixing section that fixes the transferred image on the transported transfer material; and a transfer material-guiding section having a guiding surface that guides the transported transfer material to the fixing section, the guiding surface being disposed in a direction in which the transfer material is sucked onto the transfer material-transporting belt relative to a transfer material-transporting surface of the transfer material-transporting belt.

4 Claims, 8 Drawing Sheets

IIB
14
14b
14c
14f
17
18
18c
19
19a
19b
20
21
22
22a
23
24
24a
25
25a
26
27
28
29
30
31
32
33
33a
33d
34
35
37
38

IMAGE FORMING APPARATUS INCLUDING A TRANSFER-MATERIAL GUIDE SECTION WITH SUCTION

BACKGROUND

1. Technical Field

The present invention relates to an electrophotographic image forming apparatus having a transfer material-gripping section and a transfer roller that transfers an image on an image carrier onto the transfer material and relates to an electrophotographic image forming method.

2. Related Art

In a wet type image forming apparatus using a liquid developer, because a surface of a transfer material, such as paper, facing a toner image is in contact with an intermediate transfer medium by being pressed thereon, the transfer material is often attached to the intermediate transfer medium after image transfer. Accordingly, in Japanese Patent No. 3,128,067, an image forming apparatus is proposed, in which air is blown to an anterior end of a transfer material after image transfer to separate the transfer material from a transfer roller.

On the other hand, with respect to an image forming apparatus using a dry developer, in JP-A-3-4241, an image forming apparatus is proposed, in which a toner image on a photoconductor is transferred onto a transfer material in a state in which an anterior end of the transfer material is gripped with a gripper of the transfer drum being in contact with the photoconductor by being pressed thereon. The transfer in a state in which the anterior end of the transfer material is gripped enables the transfer material to be easily separated from the photoconductor after image transfer. Furthermore, in JP-A-6-135613, an image forming apparatus is proposed, in which a transfer material-transporting belt having a plurality of suction holes transports a transfer material after image transfer while subjecting the transfer material to suction, and in which the transfer material is guided to a fixing section with a guide. The transfer material-transporting belt transports the transfer material while subjecting the material to suction, so that it is possible to achieve excellent transportability for the transfer material and to achieve excellent fixing.

Meanwhile, in the image forming apparatus disclosed in Japanese Patent No. 3,128,067, because air is merely blown to an anterior end of the transfer material, it is difficult to steadily separate the transfer material. Accordingly, it may be proposed that a technique for separating the transfer material at the anterior end thereof with the gripper, which is disclosed in JP-A-3-4241, is applied to the image forming apparatus using the liquid developer, which is disclosed in Japanese Patent No. 3,128,067. Furthermore, it may be proposed that the transfer material-transporting belt disclosed in JP-A-6-135613 is applied to the image forming apparatus disclosed in Japanese Patent No. 3,128,067. Unfortunately, in cases where the gripper grips the anterior end of the transfer material, the gripped portion of the transfer material is deformed into an undulating shape as shown in FIG. 8, and the transfer material is folded in a direction away from a surface onto which a toner image is transferred, resulting in a mark of the gripping being left behind. Consequently, the guide catches the anterior end of the transfer material transported with the transfer material-transporting belt, so that the transfer material may jam.

As a result, it is difficult to apply the technique for separating the transfer material, which is disclosed in JP-A-3-4241, and the technique for transporting the transfer material while subjecting the material to suction, which is disclosed in JP-A-6-135613, to the image forming apparatus disclosed in Japanese Patent No. 3,128,067 to achieve excellent fixing and to excellently form an image.

SUMMARY

An advantage of some aspects of the invention is that it provides an image forming apparatus and an image forming method in which it is possible to excellently form an image even though a transfer material-gripping member grips an anterior end of the transfer material.

According to an aspect of the invention, a guiding surface of a transfer material-guiding section is disposed in a direction in which the transfer material is sucked onto a transfer material-transporting belt relative to a transfer material-transporting surface of the transfer material-transporting belt, the guiding surface guiding a transfer material to a fixing member, and the transfer material-transporting belt transporting the transfer material while subjecting the material to suction. By virtue of this advantage, even though a transfer material-gripping member grips the transfer material to leave behind a mark of a fold, the transfer material-guiding section does not catch the transfer material transported with the transfer material-transporting belt, so that it is possible to steadily and stably transport the transfer material to the guiding surface of the transfer material-guiding section. Consequently, it is possible to achieve excellent fixing.

It is preferable that the transfer material-guiding section has a curved portion at a position facing a winding portion at which the transfer material-transporting belt is looped around a roller. By virtue of this advantage, it is possible to position an end of the curved portion being nearest to the transfer material-transporting belt toward a transfer roller relative to an end of the winding portion, at which the transfer material-transporting belt is looped around the roller, being nearest to a fixing section. Namely, it is possible to dispose the guiding surface of the transfer material-guiding section so as to be more adjacent to the transfer material-transporting belt. Consequently, it is possible to more smoothly transport the transfer material without the material being caught with the transfer material-guiding section.

It is preferable that the guiding surface of the transfer material-guiding section is tilted with respect to the transfer material-transporting surface of the transfer material-transporting belt in a direction in which the anterior end of the transfer material is folded by gripping of material-gripping member. By virtue of this advantage, even though a transfer material-gripping member grips the transfer material to leave behind a mark of a fold, it is possible to prevent the transfer material from being caught with the transfer material-guiding section. Consequently, it is possible to steadily move the transfer material transported with the transfer material-transporting belt. As a result, it is possible to smoothly and suitably transport the transfer material.

According to another aspect of the invention, the transfer material-gripping member grips the transfer member, so that it is possible to steadily separate the transfer material from the transfer roller. Especially, in an image forming apparatus using a liquid developer, it is possible to efficiently separate the transfer material from the transfer roller.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
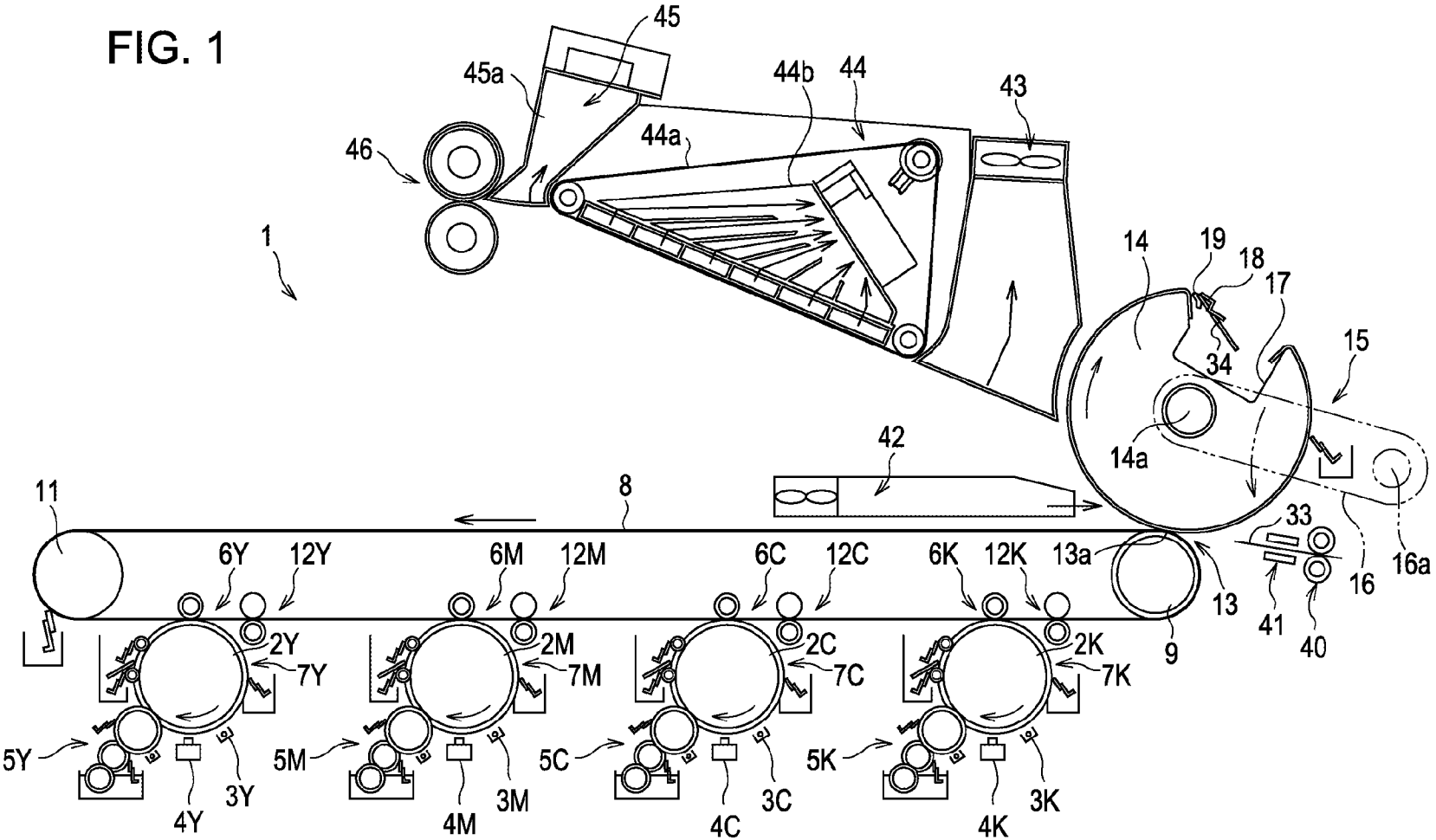
FIG. 1 schematically and partially illustrates an image forming apparatus having a fixing device according to a first example of an embodiment of the invention.

Embodiments of the invention will be described hereinafter with reference to the accompanying drawings. FIG. 1 schematically and partially illustrates an image forming apparatus having a fixing device according to a first example of an embodiment of the invention. In an image forming apparatus 1 in the first example, an image is formed with a liquid developer containing a solid toner and a carrier liquid. With reference to FIG. 1, the image forming apparatus 1 includes photoconductors 2Y, 2M, 2C, and 2K as image carriers for respective colors of yellow (Y), magenta (M), cyan (C), and black (K), each photoconductor being horizontally or substantially horizontally disposed in tandem. In each of the photoconductors 2Y, 2M, 2C, and 2K, the photoconductor 2Y is for yellow, and the photoconductor 2M is for magenta, and the photoconductor 2C is for cyan, and the photoconductor 2K is for black. Similarly, colors of other members are indicated by adding the description of each of the colors Y, M, C, and K to the number of each member.

Charging sections 3Y, 3M, 3C, and 3K are disposed in the vicinity of each of the photoconductors 2Y, 2M, 2C, and 2K, respectively. In addition, exposure sections 4Y, 4M, 4C, and 4K, developing sections 5Y, 5M, 5C, and 5K, primary transfer sections 6Y, 6M, 6C, and 6K, and photoconductor cleaning sections 7Y, 7M, 7C, and 7K are respectively disposed in a rotational direction of each of the photoconductors 2Y, 2M, 2C, and 2K in sequence beginning with the charging sections 3Y, 3M, 3C, and 3K.

Furthermore, the image forming apparatus 1 includes an endless intermediate transfer belt 8 (corresponding to an image carrier) as a transfer belt. The intermediate transfer belt 8 is disposed above each of the photoconductors 2Y, 2M, 2C, and 2K. The intermediate transfer belt 8 is in contact with each of the photoconductors 2Y, 2M, 2C, and 2K by being pressed thereon with the respective primary transfer sections 6Y, 6M, 6C, and 6K.

Although it is not shown in the figure, the intermediate transfer belt 8 is formed into a relatively soft and elastic belt, for example, having a trilaminar structure including a flexible substrate made from a resin or the like, an elastic layer made from rubber or the like and formed on the substrate, and a surface layer formed on the elastic layer. Obviously, the intermediate transfer belt 8 is not limited to this example. The intermediate transfer belt 8 is looped around an intermediate transfer belt-driving roller 9 to which the driving force of a motor (not shown) is transmitted and around an intermediate transfer belt-tension roller 11. The intermediate transfer belt 8 is configured so as to rotate in a direction indicated by an arrow in a state in which a tension is imparted. Meanwhile, the sequence in which members respectively corresponding to each of the colors of Y, M, C, and K, such as the photoconductors, are disposed is not limited to the example shown in FIG. 1, and it is possible to arbitrarily configure the sequence.

Intermediate transfer belt-squeezing devices 12Y, 12M, 12C, and 12K are disposed on the intermediate transfer belt 8 at a position in the vicinity of the respective primary transfer sections 6Y, 6M, 6C, and 6K in a forward direction of the rotation of the intermediate transfer belt 8 relative to the respective primary transfer sections 6Y, 6M, 6C, and 6K. Furthermore, a secondary transfer section 13 as a transfer device is disposed on the side of the intermediate transfer belt-driving roller 9 of the intermediate transfer belt 8.

The secondary transfer section 13 includes a secondary transfer roller 14 and a secondary transfer roller-cleaning section 15. The two ends of a rotating shaft 14*a* of the secondary transfer roller 14 are rotatably supported by a pair of secondary transfer roller-supporting frames 16. The secondary transfer roller-supporting frames 16 rotationally oscillate about a rotating shaft 16*a* (a pivot point) supported by an apparatus body (not shown) and are biased with a biasing unit (not shown) such as a spring in a direction indicated by an arrow. The secondary transfer roller 14 is in contact with the intermediate transfer belt 8 by being pressed thereon through a pressing force of the biasing unit. In this case, the intermediate transfer belt-driving roller 9 functions as a backup roller of the secondary transfer roller 14 for the pressing force.

Figures 2A, 2B, 2C:
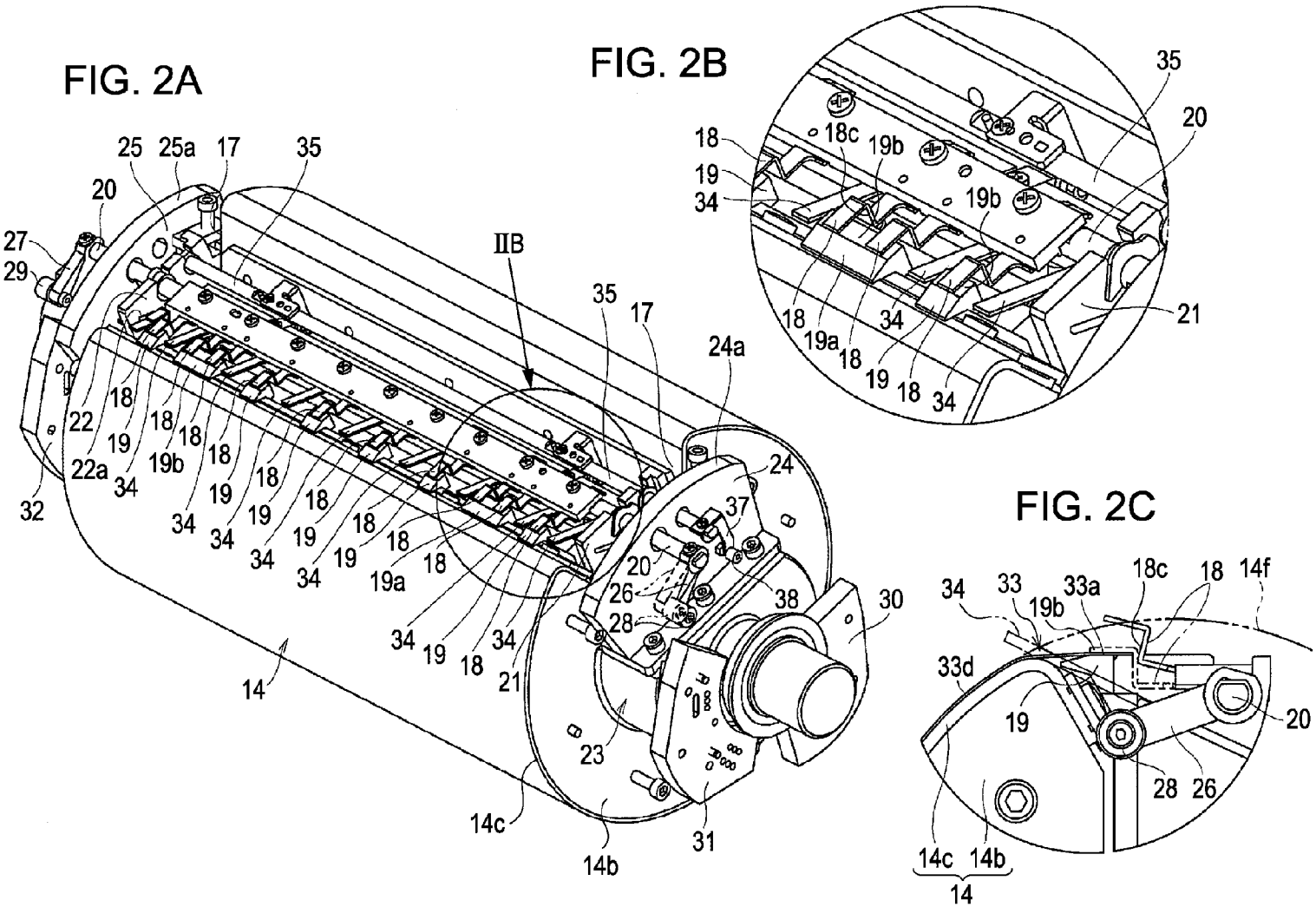
FIG. 2A is a partial perspective view illustrating a secondary transfer section of the image forming apparatus in the first example.
FIG. 2B is an enlarged view illustrating an encircled portion IIB in FIG. 2A.
FIG. 2C is a partial right side view of FIG. 2A.
Figure 3:
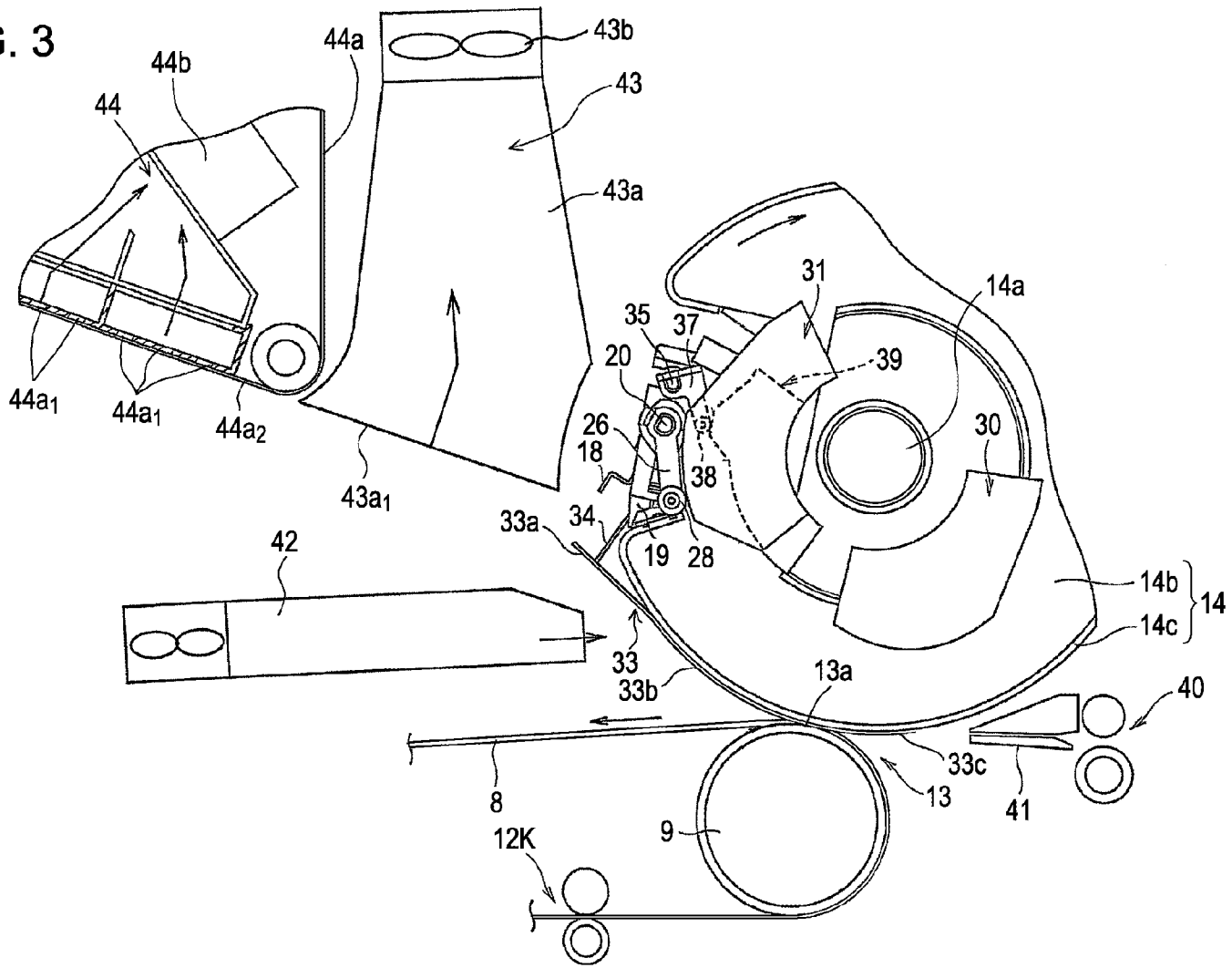
FIG. 3 illustrates the removal of a transfer material from a secondary transfer roller after image transfer.

Furthermore, the secondary transfer roller 14 has a depressed portion 17. With reference to FIG. 2A, the depressed portion 17 extends in an axial direction of the secondary transfer roller 14. Moreover, the secondary transfer roller 14 has a base member 14*b* and a sheet-like elastic member 14*c* applied to a peripheral surface of an arcuate portion of the base member 14*b*. The elastic member 14*c* functions as a resistance layer on the peripheral surface of the arcuate portion of the secondary transfer roller 14. A secondary transfer nip 13*a* is formed between the intermediate transfer belt 8 and the elastic member 14*c* of the secondary transfer roller 14 as shown in FIGS. 1 and 3.

Furthermore, a transfer bias voltage, by which a toner image transferred onto the intermediate transfer belt 8 is transferred onto a transfer material such as transfer paper, is applied to the secondary transfer roller 14. The secondary transfer roller 14 rotates in a direction indicated by an arrow during the rotation of the intermediate transfer belt 8 in a direction indicated by another arrow, and transfers the toner image on the intermediate transfer belt 8 onto the transfer material at the secondary transfer nip 13*a* by the application of the transfer bias voltage.

A gripper 18 as a transfer material-gripping member of the invention and a gripper-supporting section 19 as a receiving member for the transfer material-gripping member is disposed in the depressed portion 17, the gripper 18 being placed on the gripper-supporting section 19. As shown in FIGS. 2A and 2B, ten grippers 18 are disposed in the axial direction of the secondary transfer roller 14. The number of the grippers 18 is not limited to ten, and it is possible to dispose an arbitrary number of grippers 18. The grippers 18 are each made of a thin strip-shaped metal plate so as to be formed into crank-like inverse "S" shapes of the same size.

Each gripper 18 is disposed on a rotating shaft 20 so as to integrally rotate with the rotating shaft 20. The two ends of the rotating shaft 20 are rotatably supported by supporting plates 21 and 22 vertically disposed at a position facing the depressed portion 17 of the secondary transfer roller 14.

A first gripper controlling-cam follower 28 is disposed at an end of the rotating shaft 20 through a first arm 26. A second gripper controlling-cam follower 29 is disposed at another end of the rotating shaft 20 through a second arm 27. The secondary transfer roller 14 rotates, so that the first gripper-controlling cam follower 28 is controlled with first and third gripper-controlling cams 30 and 31. Furthermore, the secondary transfer roller 14 rotates, so that the second gripper-controlling cam follower 29 is controlled with a second gripper-controlling cam (not shown) and a fourth gripper-controlling cam 32 having configurations the same as those of the first gripper-controlling cam 30 and the third gripper-controlling cams 31, respectively. The first and second gripper-controlling cam followers 28 and 29 are controlled in synchronization with each other.

With reference to FIG. 2A, eight gripper-supporting sections 19 are disposed in the axial direction of the secondary transfer roller 14. The number of the gripper-supporting sections 19 is not limited to eight, and it is possible to dispose the gripper-supporting sections 19 in a number corresponding to the number of the grippers 18. In addition, among the eight gripper-supporting sections 19, two gripper-supporting sections 19*a*, which are each placed near the two ends of the secondary transfer roller 14, are configured so as to be longer than other gripper-supporting sections 19 in the axial direction of the secondary transfer roller 14. Consequently, it is possible to support a size of a transfer material 33 in the axial direction of the secondary transfer roller 14.

With reference to FIGS. 2B and 2C, the gripper-supporting sections 19 and 19*a* individually have a gripper abutting portion 19*b* on which the gripper 18 abuts. It is configured such that each gripper 18 abuts on and separates from each of the corresponding abutting-portions 19*b* of the gripper-supporting sections 19 and 19*a*. The first and second gripper-controlling cam followers 28 and 29 are controlled, so that the grippers 18 are controlled to abut on and separate from the gripper-supporting sections 19 and 19*a*.

Namely, as shown in FIG. 2C, in cases where an anterior end 33*a* of the transfer material 33, which is transported from a gate roller 40 through a transfer material-feeding guide 41, abuts on a step 18*c* of the gripper 18, the first and the second gripper-controlling cam followers 28 and 29 are controlled, so that the anterior end 33*a* is gripped between the gripper 18 and the gripper abutting portion 19*b* of the gripper-supporting sections 19 or 19*a*. The transfer material 33 is gripped immediately before the depressed portion 17 reaches a position corresponding to a secondary transfer nip. The transfer material-gripping section is configured with the gripper 18 and gripper-supporting sections 19 and 19*a*. Meanwhile, the gripper 18 grips the anterior end 33*a* of the transfer material 33 such that the anterior end 33*a* is folded in a direction away from a transfer surface 33*d* of the transfer material 33, onto which a toner image is transferred.

Once the gripper 18 has gripped the transfer material 33, the transfer material 33 comes to abut on a peripheral surface of the secondary transfer roller 14 toward a posterior end 33*c* in series. Furthermore, after the depressed portion 17 has passed the position corresponding to the secondary transfer nip, the first and second gripper-controlling cam followers 28 and 29 are controlled, so that the gripper 18 separates from the gripper-supporting section 19 to release the anterior end 33*a* of the transfer material 33.

The term "the position corresponding to the secondary transfer nip" used herein is defined in the following. Namely, in cases where the depressed portion 17 (a portion formed into a depressed shape, specifically) of the secondary transfer roller 14 is located at a position facing the intermediate belt-driving roller 9, the depressed portion 17 does not abut on the intermediate transfer belt 8. Accordingly, the secondary transfer nip 13*a* is not formed between the intermediate transfer belt 8 and the secondary transfer roller 14. In a position at which the secondary transfer nip 13*a* is formed, the secondary transfer roller 14 is in contact with the intermediate transfer belt 8 by being pressed thereon, and the width of the secondary transfer roller 14 and the intermediate transfer belt 8 is maximized in each rotational direction. In cases where the depressed portion 17 faces the position at which the secondary transfer nip 13*a* should be formed, the position is referred to as the position corresponding to the transfer nip.

In cases where the transfer material 33 is gripped, the rotation of the secondary transfer roller 14 has a vector component having the same direction as a direction of the movement of the transfer material 33 transported from the gate roller 40. Accordingly, in a state in which the gripper 18 is separating from the gripper-supporting section 19, the anterior end 33*a* of the transfer material 33 comes between the gripper 18 and the gripper-supporting section 19 such that the anterior end 33*a* chases the moving gripper 18. Then, the gripper 18 presses the anterior end 33*a* of the transfer material 33 to the gripper-supporting section 19 so as to grip the transfer material 33.

As indicated by a long dashed short dashed line in FIG. 2C, in cases where the anterior portion 33*a* of the transfer material 33 is gripped between the gripper-supporting section 19 and a gripping portion as an anterior end of the gripper 18, the gripper 18 is configured so as to be entirely accommodated inside a hypothetical outline 14*f* of the elastic member 14*c* of the secondary transfer roller 14. In cases where the gripper 18 is at a release position indicated by a solid line in FIG. 2C, the gripping portion as the anterior end of the gripper 18 is projected outside the hypothetical outline 14*f* of the elastic member 14*c*.

A toner image on the intermediate transfer belt 8 is transferred onto the transfer material 33 at the secondary transfer nip 13*a* (a transfer process), while the gripper 18 grips the anterior end 33*a* of the transfer material 33. A circumferential length of the secondary transfer roller 14 is configured so as to be larger than a length of the transfer material 33 having a maximum length in a transport direction of the transfer material among the transfer materials 33 used in the image forming apparatus 1 in the first example, the circumferential length not including the width of the depressed portion 17 in the rotational direction of the secondary transfer roller 14. Consequently, the toner image on the intermediate transfer belt 8 is also steadily transferred onto the transfer material 33 having the maximum length.

In cases where the gripping portion of each gripper 18 that grips the anterior end 33*a* of the transfer material 33 has passed the secondary transfer nip 13*a*, each gripper 18 starts to move in a direction in which the gripper 18 separates from the gripper-supporting section 19, so that the anterior end 33*a* of the transfer material 33 begins to be released.

Furthermore, a projecting pawl 34 as a transfer material-separating member is disposed in the depressed portion 17. As shown in FIG. 2A, the nine projecting pawls 34 are disposed in the axial direction of the secondary transfer roller 14.

The number of the projecting pawls 34 is not limited to nine, and it is possible to dispose an arbitrary number of the projecting pawls 34. The projecting pawls 34 are each made of a thin strip-shaped metal plate so as to be formed into the same shape and in the same size. Each projecting pawl 34 is guided by liner guide openings formed on the supporting plates 21 and 22 to be integrally moved in a linear manner. On the other hand, a rotating shaft 35 is supported by the supporting plates 21 and 22 for relative rotation. A known motion conversion mechanism (not shown) converts the rotation of the rotating shaft 35 into linear motion of each projecting pawl 34.

Each projecting pawl 34 linearly moves between an accommodated position indicated by a solid line in FIG. 2C and a projecting position indicated by a long dashed short dashed line in FIG. 2C. Accordingly, in cases where each projecting pawl 34 is in the accommodated position, each projecting pawl 34 is entirely located inside the hypothetical outline 14*f* (in the depressed portion, in other words). In addition, in cases where each projecting pawl 34 is in the projecting position, an anterior end thereof projects outside the hypothetical outline 14*f* (outside the depressed portion 17, in other words). The projecting pawl 34 does not abut on a back surface of the transport material 33 in the accommodated position, and abuts on the back surface of the transport material 33 to make the transfer material 33 protrude from the peripheral surface of the secondary transfer roller 14 (in other words, the back surface of the transfer material 33 is separated from the peripheral surface of the secondary transfer roller 14) in the projecting position.

With reference to FIGS. 2A and 3, a first projecting pawl-controlling cam follower 38 is disposed through an arm 37 at an end of the rotating shaft 35 passing through the supporting plate 21. In addition, a second projecting pawl-controlling cam follower (not shown) having the same configuration as that of the first projecting pawl-controlling cam follower 38 is disposed through the arm (not shown) having the same configuration as that of the arm 37 at another end of the rotating shaft 35 passing through the supporting plate 22. The secondary transfer roller 14 rotates, so that a first projecting pawl-controlling cam 39 controls the first projecting pawl-controlling cam follower 38. Furthermore, the secondary transfer roller 14 rotates, so that a second projecting pawl-controlling cam (not shown) controls the second projecting pawl-controlling cam follower (not shown). The first and second projecting pawl-controlling cam followers are controlled in synchronization with each other.

As shown in FIG. 3, after the depressed portion 17 has passed the position corresponding to the transfer nip by the rotation of the secondary transfer roller 14, the gripper 18 releases the anterior end 33*a* of the transfer material 33, and immediately each projecting pawl 34 moves to be in the projecting position to separate the back surface of the transfer material 33 from the peripheral surface of the secondary transfer roller 14. The secondary roller 14 further rotates, so that each projecting pawl 34 separates from the back surface of the transfer material 33 with the result that each projecting pawl 34 moves to the accommodated position. Each projecting pawl 34 is held in the accommodated position until each projecting pawl 34 moves to the projecting position in tandem with the release of the anterior end 33*a* of the transfer material 33 from the gripper 18 in the subsequent image formation, as in the case described above.

With reference to FIG. 2A, an abutting member-supporting section 23 is provided at an end of the secondary transfer roller 14 so as to integrally rotate with the secondary transfer roller 14. A first abutting member 24 as a first positioning member is vertically disposed on the abutting member-supporting section 23. Similarly, another abutting member-supporting section having the same configuration as that of the abutting member-supporting section 23 is provided at another end of the secondary transfer roller 14, and a first abutting member 25 as a first positioning member is also vertically disposed on the abutting member-supporting section. The first abutting members 24 and 25 are individually integrated with the secondary transfer roller 14. The first abutting members 24 and 25 respectively have arcuate peripheral surfaces 24*a* and 25*a* concentric with a circle of the arcuate peripheral surface of the secondary transfer roller 14.

Meanwhile, although it is not shown in the figures, second abutting members as second positioning members are individually provided at the two ends of a rotating shaft of the intermediate transfer belt-driving roller 9. In cases where the first abutting members 24 and 25 are at a position not facing each of the second abutting members, the elastic member 14*c* of the secondary transfer roller 14 abuts on the intermediate transfer belt 8 to form the secondary transfer nip 13*a*. In this case, the depressed portion 17 of the secondary roller 14 hardly faces the position corresponding to the secondary transfer nip.

In cases where the first abutting members 24 and 25 are at a position facing each of the second abutting members, the peripheral surfaces 24*a* and 25*a* of the first abutting members 24 and 25 respectively abut on the corresponding second abutting members. In this case, the depressed portion 17 of the secondary transfer roller 14 partially or entirely faces the position corresponding to secondary transfer nip. Even though the depressed portion 17 faces the position corresponding to the secondary transfer nip, the abutting members 24 and 25 abut on the second abutting members in this manner, so that the secondary transfer roller 14 is positioned substantially constant without significant positional variation with respect to the intermediate transfer belt 8 and the intermediate transfer belt-driving roller 9.

A secondary transfer roller-cleaning section 15 has a cleaning member 15*a* such as a cleaning blade and has a liquid developer-recovering container 15*b*. The cleaning member 15*a* abuts on a peripheral surface of the elastic member 14*c* of the secondary transfer roller 14 to separate the liquid developer adhered to the elastic member 14*c*. The liquid developer-recovering container 15*b* recovers the liquid developer removed with the cleaning member 15*a* to store the recovered developer.

Figure 5:
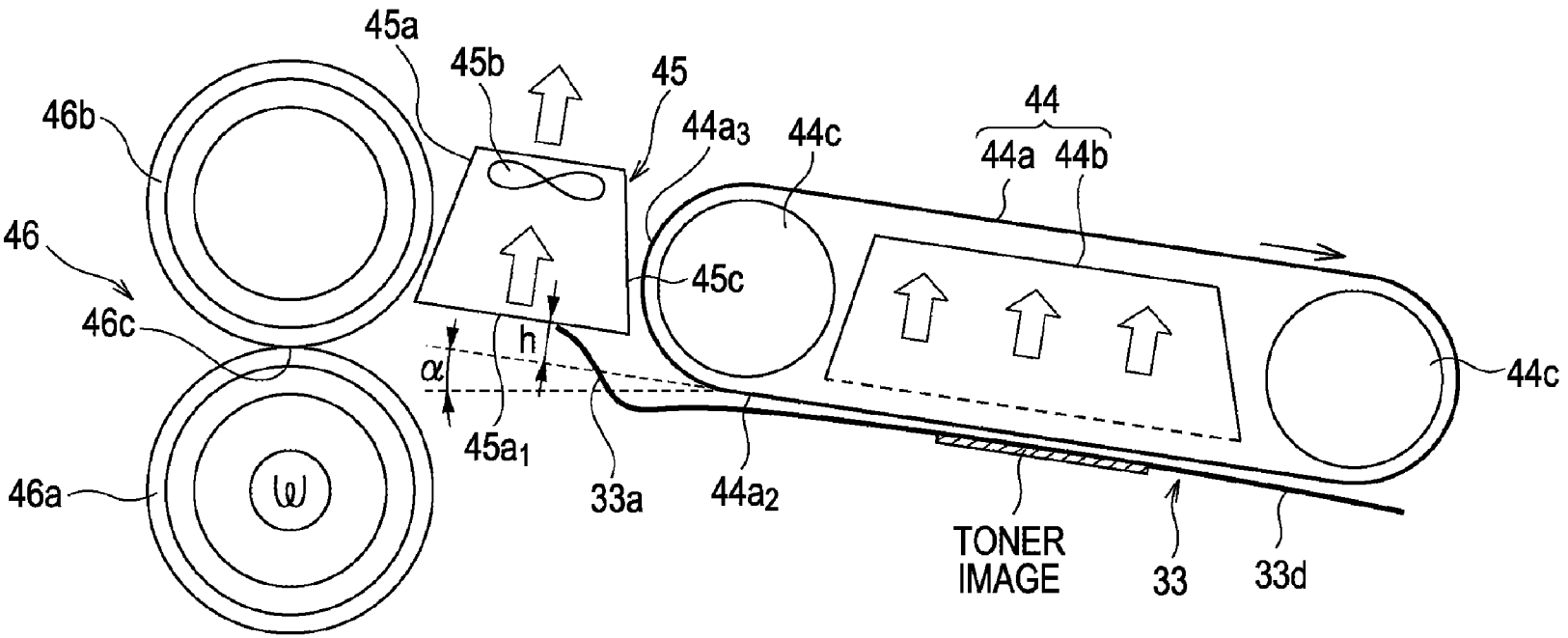
FIG. 5 schematically and partially illustrates a transfer material-guiding section and a fixing section according to a second example of the embodiment of the image forming apparatus of the invention.

Furthermore, with reference to FIGS. 1 and 5, the image forming apparatus 1 includes a first airflow generator 42, a second airflow generator 43, a transfer material-transporting section 44, a third airflow generator 45, and a fixing section 46. The first airflow generator 42 blows air to the anterior end 33*a* of the transfer material 33 released from the gripper 18 as indicated by an arrow. Consequently, it is possible to prevent the anterior end 33*a* of the transfer material 33 from staying on the intermediate transfer belt 8.

The second air generator 43 has a plurality of airflow vents (not shown) to suction air through the airflow vents in a direction indicated by an arrow. With reference to FIG. 3, the transfer material 33 separated from the secondary transfer roller 14 is guided along a guiding surface 43$a_1$ of a suctioning member 43*a* of the second airflow generator 43 while the second air flow generator 43 suctions a back surface of the transfer material 33 (an opposite surface of an image transfer surface 33*d*). The transfer material 33 is transported to the transfer material-transporting section 44 by rotational force of the intermediate transfer belt 8 and the secondary transfer roller 14.

The transfer material-transporting section 44 has a plurality of airflow vents 44$a_1$ (shown in FIG. 3), an endless transfer material-transporting belt 44*a* rotating in a direction indicated by an arrow, and a suctioning member 44*b*. The anterior end 33*a* of the transfer material 33 guided from the second airflow generator 43 is moved to the transfer material-transporting belt 44*a* of the transfer material-transporting section 44. In this case, the depressed portion 17 does not face the position corresponding to the secondary transfer nip, and the elastic member 14*c* abuts on the intermediate transfer belt 8. An intermediate portion 33*b* of the transfer material 33 abuts on the suctioning member 43*a* of the second airflow generator 43, and the posterior end 33*c* of the transfer material 33 abuts on the elastic member 14*c* of the secondary transfer roller 14.

Figure 4:
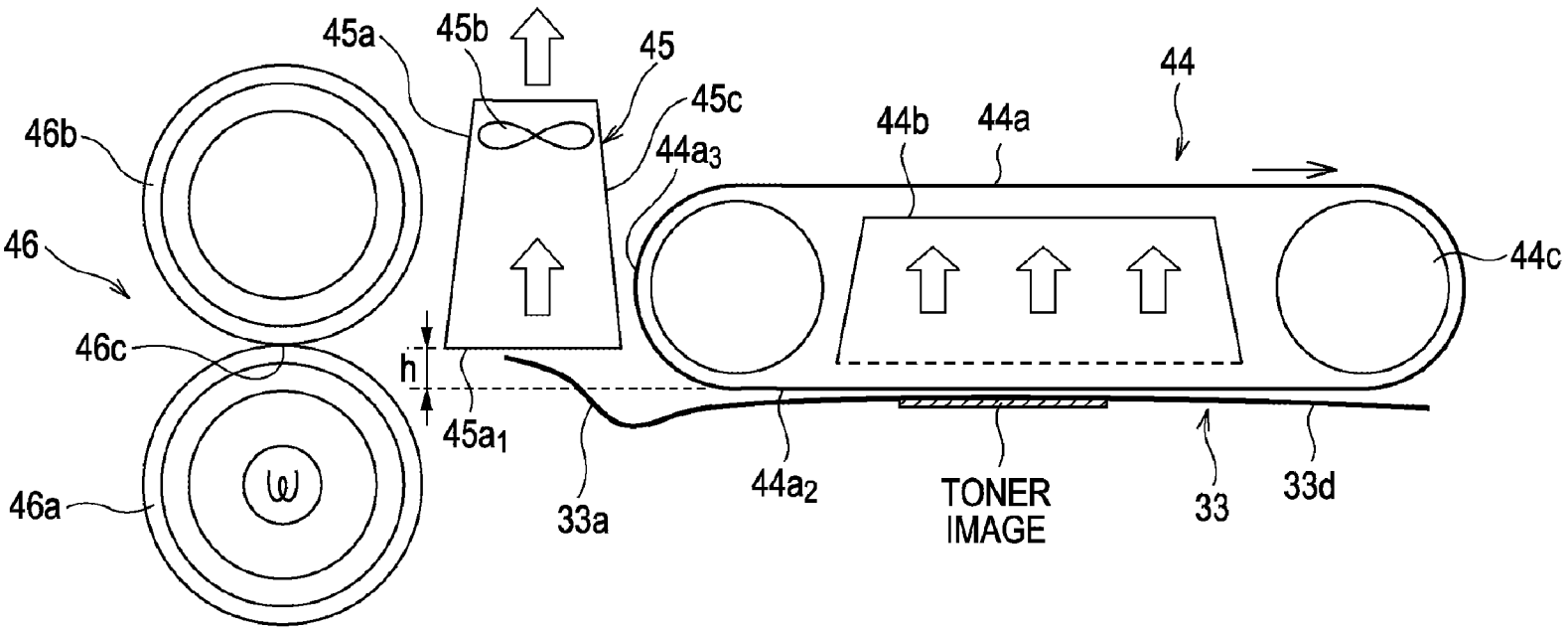
FIG. 4 schematically illustrates a transfer material-guiding section and a fixing section in the first example.

As shown in FIGS. 1, 3, and 4, the suctioning member 44*b* suctions air through the airflow vent 44$a_1$ of the transfer material-transporting belt 44*a* in a direction indicated by an arrow. The transfer material 33 is transported upside down to a third airflow generator 45 with the transfer material-transporting belt 44*a*, while the suctioning member 44*b* suctions air to attract the transfer material 33 through the transfer material-transporting belt 44*a*. Although FIG. 1 illustrates the transfer material-transporting belt 44*a* looped around the three winding rollers, FIG. 4 illustrates the same looped around the two winding rollers 44*c*. For a reason of simplicity of description in the drawing, FIG. 4 illustrates only the two winding rollers 44*c*, but the transfer material-transporting belt 44*a* shown in FIG. 4 is configured so as to be looped around the three winding rollers. Obviously, the transfer material-transporting belt 44*a* shown in FIG. 1 may be looped around the two winding rollers.

The third airflow generator 45 has a suctioning member 45*a* having a guiding surface 45$a_1$ that guides the transfer material 33, and has an airflow generating member 45*b*. The suctioning member 45*a* is provided with a plurality of airflow vents (not shown). The air generating member 45*b* suctions air through the airflow vents of the suctioning member 45*a* in a direction indicated by an arrow. The airflow generating member 45*b* suctions the air, so that a back surface of the transfer material 33 is guided while being sucked onto the guiding surface 45$a_1$ of the suctioning member 45*a*. Consequently, the transfer material 33 is guided to the fixing section 46 by transporting force of the transfer material-transporting belt 44*a*. The third airflow generator 45 is disposed in a direction in which the transfer material 33 is sucked onto the transfer material-transporting belt 44*a*, and configures the transfer material-guiding section of the invention.

Meanwhile, with reference to FIG. 4, in the image forming apparatus 1 in the example, a transfer material-transporting surface 44$a_2$ of the transfer material-transporting belt 44*a* is configured so as to be horizontal. Similarly, in the third airflow generator 45, a guiding surface 45$a_1$ of the supporting member 45*a* is also configured so as to be horizontal. In this case, the guiding surface 45$a_1$ is located at an upper portion relative to the transfer material-transporting surface 44$a_2$ by a vertical height (distance) h (in a direction same as a direction in which the anterior end 33*a* of the transfer material 33 is folded). Accordingly, even though the anterior end 33*a* of the transfer material 33 is folded due to gripping by the gripper 18, the anterior end 33*a* is steadily and stably transported from the transfer material-transporting belt 44*a* to the guiding surface 45$a_1$. The height h is arbitrarily configured on the basis of a relationship between a distance from a reversing portion (a winding portion) 44$a_3$ to a facing portion 45*c* of the third air flow generator 45 and a degree at which the anterior end 33*a* of the transfer material 33 is folded, the facing portion 45*c* facing the reversing portion 44$a_3$. In this case, it is desirable that the degree is configured as a degree at which a maximally foldable transfer material 33 is folded in the case of releasing from the gripping by the gripper 18, the maximally foldable transfer material 33 being selected from among the transfer materials 33 used in the image forming apparatus 1 of the embodiment.

The fixing section 46 has a heating roller 46*a* and a pressing roller 46*b*. The pressing roller 46*b* is in contact with the heating roller 46*a* by being pressed thereon to form a fixing nip 46*c* therebetween. The fixing nip 46*c* is configured at the same height as the guiding surface 45$a_1$ of the third airflow generator 45, or at a position slightly higher than the same. The heat roller 46*a* and the pressing roller 46*b* apply heat and pressure to a toner image on the transfer material 33 to fix the image (a fixing process). Subsequently, the transfer material is ejected to an output tray (not shown). Because the other configurations or other image forming operation in the image forming apparatus 1 in the first example are same as image forming apparatuses using a liquid developer in the related art, the description thereof is omitted.

According to the image forming apparatus 1 in the first example, the gripper 18 grips the anterior end 33*a* of the transfer material 33, so that it is possible to steadily separate the transfer material 33 from the secondary transfer roller 14. Especially, because the image forming apparatus 1 uses a liquid developer, it is possible to more effectively separate the transfer material 33 from the secondary transfer roller 14.

Furthermore, according to the image forming apparatus 1 and the image forming method in the first example, the guiding surface 45$a_1$ of the suctioning member 45*a* of the third airflow generator 45 is located at an upper portion relative to the transfer material-transporting surface 44$a_2$ by the height (distance) h (in a direction in which the anterior end 33*a* of the transfer material 33 is folded). Consequently, even though the gripper 18 grips the anterior end 33*a* of the transfer material 33 to leave behind a mark of a fold, it is possible to steadily and stably transport the transfer material 33 from the transfer material-transporting belt 44*a* to the guiding surface 45$a_1$ without the transfer material 33 being caught with the suctioning member 45*a* of the third airflow generator 45. As a result, it is possible to improve the transportability of the transfer material-transporting section 44 for a transfer material.

The image forming apparatus 1 in the first example will be specifically described. The transfer material-transporting belt 44*a* shown in FIG. 4 is made from an Ethylene Propylene Diene Monomer (EPDM) rubber. Each two winding roller 44*c*, around which the transfer material-transporting belt 44*a* is looped, is made from a free-cutting steel (SUM:JIS G4804) material having a diameter of 40 mm. A center distance between the two winding rollers 44*c* is 150 mm.

The heating roller 46*a* of the fixing section 46 is configured so as to have a diameter of 60 mm, and has a cylindrical core made from aluminum having a thickness of 2 mm, an elastic layer formed on a surface of the core and made from silicon rubber having a thickness of 2 mm, a release layer (a surface layer) formed on a surface of the elastic layer and made from a perfluoroalkoxy (PFA) resin having a thickness of 30 μm, and a halogen heater disposed inside the cylindrical core. In addition, it is possible to use iron, stainless steel, and brass as a material of the core. Furthermore, it is possible to use fluoro-rubber and polyurethane rubber as a material of the elastic layer. Moreover, it is possible to use a polytetrafluoroethylene (PTFE) resin, a Fluorinated Ethylene Propylene (FEP) resin, and an ethylene tetrafluoroethylene (ETFE) resin as a material of the release layer.

The pressing roller 46*b* of the fixing section 46 is configured so as to have a diameter of 60 mm, and has a cylindrical core made from aluminum having thickness of 2 mm, an elastic layer formed on a surface of the core and made from silicon rubber having a thickness of 2 mm, a release layer (surface layer) formed on a surface of the elastic layer and made from a perfluoroalkoxy (PFA) resin having a thickness of 30 μm, and a halogen heater disposed inside the cylindrical core. In addition, it is possible to use iron, stainless steel, and brass as a material of the core. Furthermore, it is possible to use fluoro-containing rubber and polyurethane rubber as a material of the elastic layer. Moreover, it is possible to use a polytetrafluoroethylene (PTFE) resin, a Fluorinated Ethylene Propylene (FEP) resin, and an ethylene tetrafluoroethylene (ETFE) resin as a material of the release layer.

The suctioning member 45*a* of the third airflow generator 45 is made from a glass fiber reinforced polyethylene terephthalate (PET) resin having a thickness of 2 mm and has a plurality of airflow vents on the guiding surface 45$a_1$ thereof. A size of each airflow vent is configured such that air is capable of flowing to suction the transfer material 33. The height h from the transfer material-transporting surface 44$a_2$ to the guiding surface 45$a_1$ is 10 mm.

FIG. 5 schematically and partially illustrates a transfer material-guiding section and a fixing section according to a second example of the embodiment of the image forming apparatus of the invention. With reference to FIG. 5, in the image forming apparatus 1 in the second example, the transfer material-transporting surface 44$a_2$ of the transfer material-transporting belt 44*a* is provided so as to be tilted upward from the second airflow generator 43 to the third airflow generator 45 by a tilt angle α with respect to a horizontal direction. Similarly, the guiding surface 45$a_1$ of the suctioning member 45*a* of the third airflow generator 45 is tilted in parallel with the transfer material-transporting surface 44$a_2$. The guiding surface 45$a_1$ is located upward by the distance h relative to the transfer material-transporting surface 44$a_2$ in a direction in which the anterior end 33*a* of the transfer material 33 is folded. The distance h is a length in a direction orthogonally intersecting the transfer material-transporting surface 44$a_2$ and the guiding surface 45$a_1$. In the embodiment, the fixing nip 46*c* is located at a lower position relative to an end of the guiding surface 45$a_1$ on a side of the fixing section 46 (in a direction opposite to the direction in which the anterior end 33*a* is folded). The other configurations of the fixing section 46 and the image forming apparatus 1 in the second example are same as those in the first example.

In the image forming apparatus 1 in the second example, the anterior end 33*a* of the transfer material 33 guided with the guiding surface 45$a_1$ abuts on the pressing roller 46*b*. Then, the pressing roller 46*b* rotates, so that the anterior end 33*a* of the transfer material 33 is guided to the fixing nip 46*c*. In this case, because the pressing roller 46*b* rotates to press the anterior end 33*a* of the transfer material 33 in a direction for correcting a fold thereof, it is possible to more smoothly guide the anterior end 33*a* of the transfer material 33 to the fixing nip 46*c*. The other effects and advantages of the fixing section 46 and the image forming apparatus 1 in the second example are same as those in the first example.

The second example will be specifically described. The transfer material-transporting surface 44$a_2$ of the transfer material-transporting belt 44*a* is tilted by the tilt angle α of 10 degrees with respect to the horizontal direction. Other configurations of the second embodiment are same as those of the first embodiment.

Figure 6:
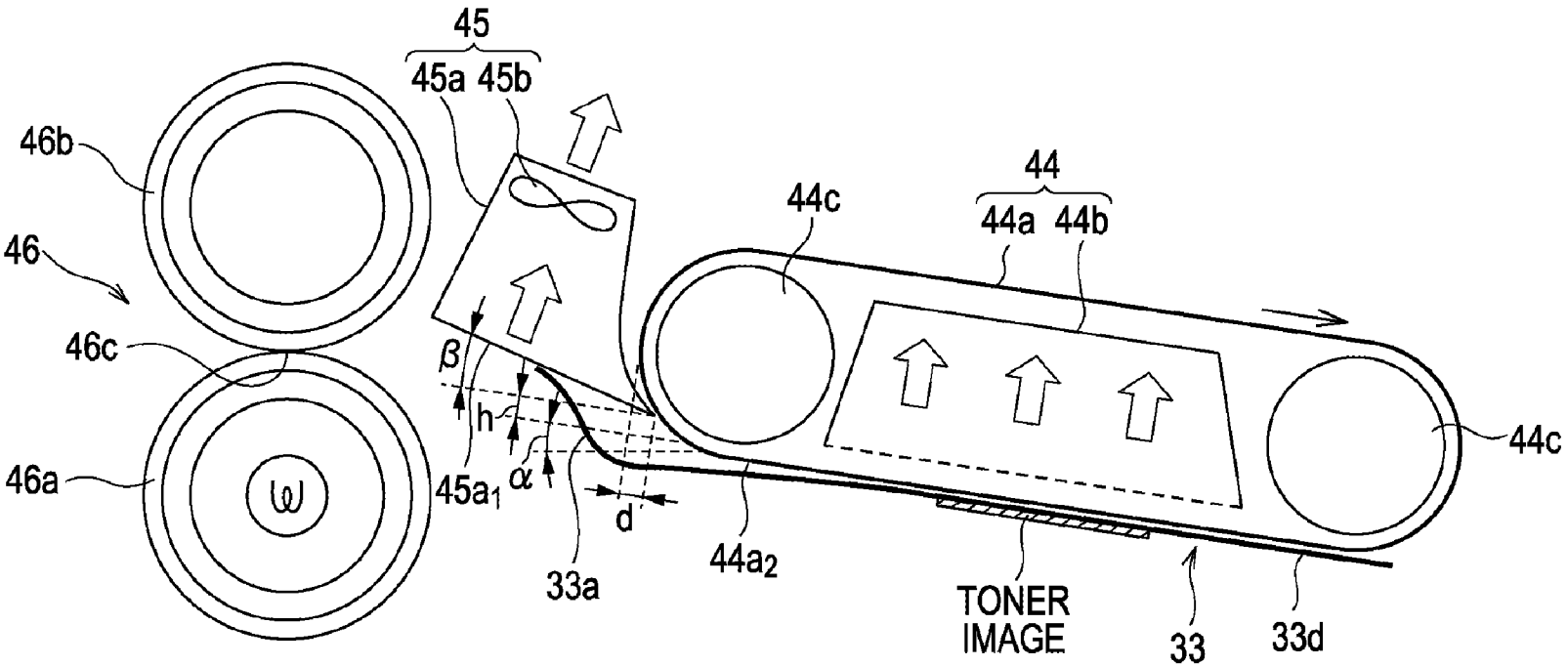
FIG. 6 schematically and partially illustrates a transfer material-guiding section and a fixing section according to a third example of the embodiment of the image forming apparatus of the invention.
Figure 7:
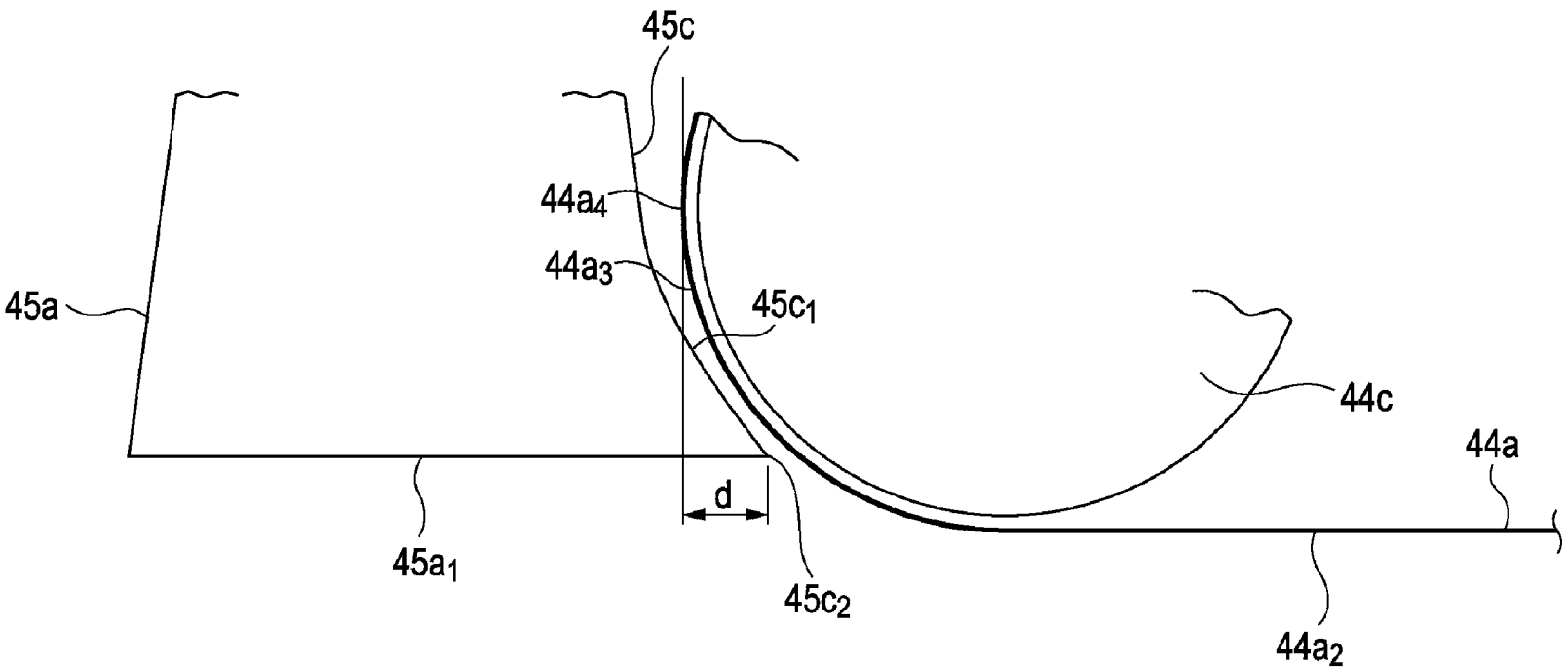
FIG. 7 is a partial enlarged view of FIG. 6.
Figure 8:
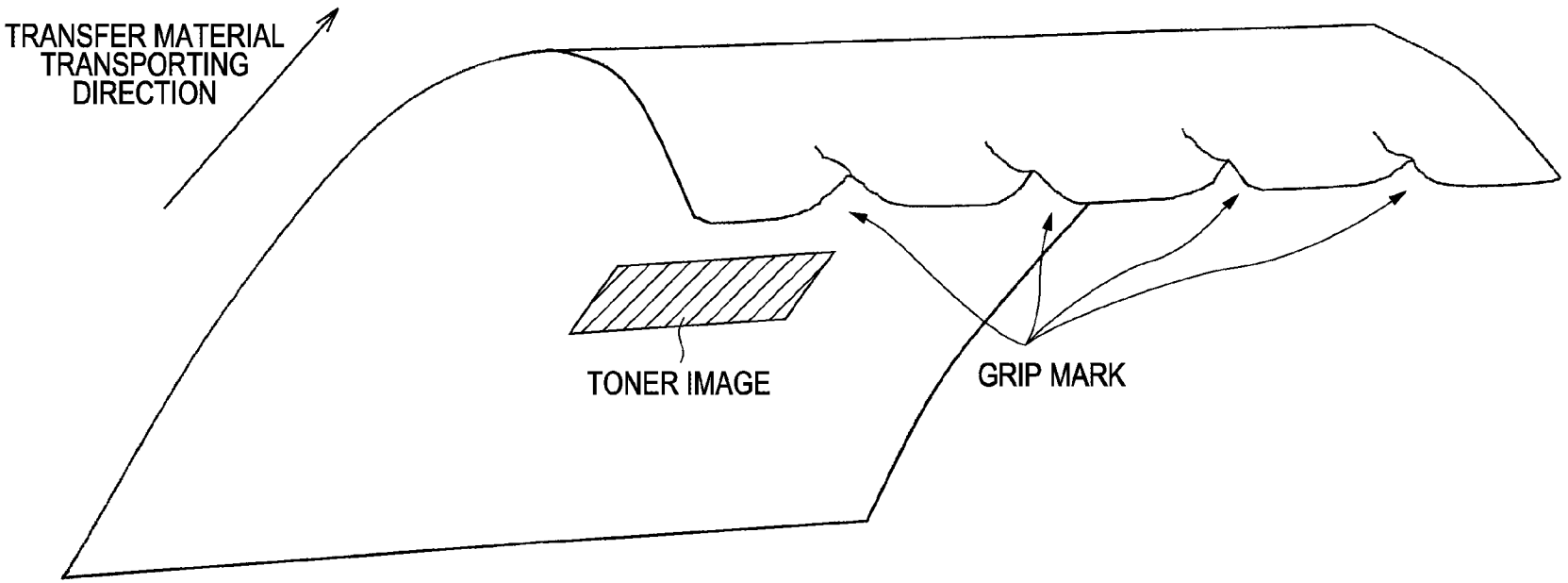
FIG. 8 illustrates marks that the transfer material has been gripped.

FIG. 6 schematically and partially illustrates a transfer material-guiding section and a fixing section according to a third example of the embodiment of the image forming apparatus of the invention. FIG. 7 is a partial enlarged view of FIG. 6. With reference to FIG. 6, in the third example of the image forming apparatus 1, the guiding surface 45$a_1$ of the guiding member 45*a* of the third airflow generator 45 is tilted by a tilt angle β with respect to the transfer material-transporting surface 44$a_2$ in a direction in which the transfer material 33 is sucked onto the transfer material-transporting belt 44 such that the guiding surface 45$a_1$ is further raised relative to the fixing section 46, as compared with the second example shown in FIG. 5.

As shown in an enlarged illustration in FIG. 7, the suctioning member 45*a* of the third airflow generator 45 has a curved portion 45$c_1$ at the facing portion 45*c* facing the reversing portion 44$a_3$ of the transfer material-transporting belt 44*a*. The curved portion 45$c_1$ is disposed along a peripheral surface of the reversing portion 44$a_3$ of the transfer material-transporting belt 44*a* looped around the winding roller 44*c* while being spaced apart from each other. An end 45$c_2$ of the curved portion 45$c_1$ is positioned toward the secondary transfer section 13 relative to an end 44$a_4$ of the reversing portion 44$a_3$ by a distance d, the end 45$c_2$ being the nearest end to the transfer material-transporting belt 44*a*, and the end 44$a_4$ being the nearest end to the fixing section 46. Namely, the guiding surface 45$a_1$ of the suctioning member 45*a* of the third airflow generator 45 is disposed so as to be more adjacent to the transfer material-transporting belt 44*a*. The other configurations of the fixing section 46 and the image forming apparatus 1 in the third example are same as those in the second example.

According to the image forming apparatus 1 in the third example, even though the gripper 18 grips the anterior end 33*a* of the transfer material 33 to leave behind a mark of a folding due to the gripping, it is possible to prevent the anterior end 33*a* of the transfer material 33 from being caught with the suctioning member 45*a* of the third airflow generator 45. Consequently, it is possible to more steadily move the transfer material 33 transported with the transfer material-transporting belt 44*a*. As a result, it is possible to more smoothly and stably transport the transfer material 33 to the fixing nip 46*c*.

The suctioning member 45*a* of the third airflow generator 45 has a curved portion 45$c_1$ at the facing portion 45*c* facing the reversing portion 44$a_3$ of the transfer material-transporting belt 44*a*. Thereby, it is possible to position the end 45$c_2$ of the curved portion 45$c_1$ toward the secondary transfer section 13 relative to the end 44$a_4$ of the reversing portion 44$a_3$ by the distance d, the end 45$c_2$ being the nearest end to the transfer material-transporting belt 44*a*, and the end 44$a_4$ being the nearest end to the fixing section 46. Namely, it is possible to dispose the guiding surface 45$a_1$ of the third airflow generator 45 so as to be more adjacent to the transfer material-transporting belt 44*a*. Consequently, it is possible to more smoothly transport the transfer material 33 without the transfer material 33 being caught with the suctioning member 45 of the third airflow generator 45. Other effects and advantages of the fixing section 46 and the image forming apparatus 1 in the third example are same as those in the second example.

The third example will be specifically described. The guiding surface 45$a_1$ is tilted by the tilt angle β of five degrees with respect to the transfer material-transporting surface 44$a_2$. The distance d between the end 45$c_2$ of the curved portion 45$c_1$ and the end 44$a_4$ of the reversing portion 44$a_3$ is 5 mm. Other configurations in the third example are same as those in the first example. It is possible to provide the suctioning member 45*a* of the third airflow generator 45 in the first and second examples with the curved portion 45$c_1$.

The image forming apparatus and the image forming method are not limited to each of the above examples. For example, although the intermediate transfer belt 8 is used as the image carrier in each of the above examples, it is possible to use an intermediate transfer drum and a photoconductor as the image carrier. In cases where the photoconductor is used as the image carrier, it will be obvious that a toner image on the photoconductor is directly transferred onto a transfer material. In addition, although a tandem image forming apparatus is employed in each of the above examples, other types of image forming apparatuses may be employed, and a monochrome image forming apparatus may be employed. Namely, it is possible to variously change designs within a scope not departing from some aspects of the invention.

The entire disclosure of Japanese Patent Application No: 2009-103667, filed Apr. 22, 2009 is expressly incorporated by reference herein.

What is claimed is:

1. An image forming apparatus comprising:

an image carrier that carries an image;

a transfer roller having a transfer material-gripping member that grips an anterior of a transfer material, the transfer roller transferring the image carried by the image carrier to the transfer material;

a transfer material-transporting belt that transports the transfer material onto which the image has been transferred while subjecting the transfer material to suction;

a fixing section that fixes the transferred image on the transported transfer material; and a transfer material-guiding section having a guiding surface that guides the transported transfer material to the fixing section, the guiding surface being disposed in a direction in which the transfer material is sucked onto the transfer material-transporting belt relative to a transfer material-transporting surface of the transfer material-transporting belt, the guiding surface being disposed relative to the transfer material-transporting belt by a vertical height such that the anterior of the transfer material is stably transported when the anterior is folded due to gripping by the transfer material-gripping member.

2. The image forming apparatus according to claim 1, wherein the transfer material-guiding section has a curved portion at a position facing a winding portion at which the transfer material-transporting belt is looped around a roller.

3. The image forming apparatus according to claim 1, wherein the guiding surface of the transfer material-guiding section is tilted with respect to the transfer material-transporting surface of the transfer material-transporting belt in a direction in which the anterior end of the transfer material is folded, and the guiding surface is further raised relative to the fixing section.

4. An image forming method comprising:

gripping an anterior of a transfer material with a transfer material-gripping member of a transfer roller;

making the transfer material on the transfer roller contact an image carrier to transfer an image onto the transfer material, the image being carried by the image carrier;

transporting the transfer material onto which the image has been transferred with a transfer material-transporting belt while subjecting the transfer material to suction;

guiding the transported transfer material with a guiding surface disposed in a direction in which the transfer material is sucked onto the transfer material-transporting belt relative to a transfer material-transporting surface of the transfer material-transporting belt, the guiding surface being disposed relative to the transfer material-transporting belt by a vertical height such that the anterior of the transfer material is stably transported when the anterior is folded due to gripping by the transfer material-gripping member; and fixing the transferred image on the guided transfer material.

* * * * *